US009649516B2

(12) United States Patent
Meyer et al.

(10) Patent No.: US 9,649,516 B2
(45) Date of Patent: May 16, 2017

(54) SHOCK ABSORBING ANCHOR ARM ASSEMBLY

(71) Applicant: D B Industries, LLC, Red Wing, MN (US)

(72) Inventors: Nathan C. Meyer, Kellogg, MN (US); Andrew C. Strauss, Goodhue, MN (US); Joshua A. Rodewald, Lake City, MN (US); Nicholas G. Bauer, Welch, MN (US)

(73) Assignee: D B Industries, LLC, Red Wing, MN (US)

( * ) Notice: Subject to any disclaimer, the term of this patent is extended or adjusted under 35 U.S.C. 154(b) by 39 days.

(21) Appl. No.: 14/736,780

(22) Filed: Jun. 11, 2015

(65) Prior Publication Data

US 2015/0360063 A1 Dec. 17, 2015

Related U.S. Application Data

(60) Provisional application No. 62/011,159, filed on Jun. 12, 2014.

(51) Int. Cl.

| | |
|---|---|
| ***A62B 35/00*** | (2006.01) |
| ***A62B 35/04*** | (2006.01) |
| ***E04G 21/32*** | (2006.01) |

(52) U.S. Cl.

CPC ..... *A62B 35/0068* (2013.01); *A62B 35/04* (2013.01); *E04G 21/3204* (2013.01); *E04G 21/329* (2013.01)

(58) Field of Classification Search

CPC ..... A62B 35/0068; A62B 35/04; B66C 23/02; B66C 23/16; B66C 23/48; B66C 23/90; E04G 21/329; E04G 21/3204

(Continued)

(56) References Cited

U.S. PATENT DOCUMENTS

| | | | |
|---|---|---|---|
| 306,134 | A | 10/1884 | Crane |
| 444,367 | A | 1/1891 | Oliver |

(Continued)

FOREIGN PATENT DOCUMENTS

| | | | |
|---|---|---|---|
| EP | 2481488 | A2 | 8/2012 |
| FR | 2981854 | A1 | 5/2013 |
| JP | 2006137540 | | 6/2006 |

OTHER PUBLICATIONS

International Search Report issued in PCT/US2015/035336 on Oct. 13, 2015, 5 pages.

(Continued)

*Primary Examiner* — Anita M King

(74) *Attorney, Agent, or Firm* — Dicke, Billig & Czaja, PLLC

(57) ABSTRACT

An assembly comprises an arm, a first connector, a second connector, an elongate member, and a shock absorber. The arm has a first arm end, a second arm end, a bore extending longitudinally through the arm, and an opening proximate the second arm end providing access to the bore. The first connector is connected to the arm proximate the first arm end, and the second connector is connected to the arm proximate the second arm end. The elongate member has an intermediate portion interconnecting a first connecting end and a second connecting end. The first connecting end is connected to the second connector, the intermediate portion extends toward the first arm end and back toward the second arm end, and the second connecting end extends through the opening. The shock absorber has a first portion connected to the first connector and a second portion connected to the intermediate portion.

17 Claims, 11 Drawing Sheets

(58) Field of Classification Search
USPC ..... 248/636; 212/238; 254/275, 374; 182/232, 234
See application file for complete search history.

(56) References Cited

U.S. PATENT DOCUMENTS

| | | | | | |
|---|---|---|---|---|---|
| 474,963 | A | | 5/1892 | Marshall | |
| 1,978,999 | A | * | 10/1934 | Jones | B66C 23/48 212/345 |
| 2,858,946 | A | * | 11/1958 | Breed | B66C 23/48 212/202 |
| 3,112,035 | A | * | 11/1963 | Knight | B66C 13/18 212/231 |
| 5,114,025 | A | | 5/1992 | Verreet | |
| 6,234,453 | B1 | * | 5/2001 | Block | B66C 23/208 212/296 |
| 6,592,101 | B2 | | 7/2003 | Vetesnik | |
| 7,350,770 | B1 | * | 4/2008 | Boyer | B66C 23/02 212/295 |
| 2012/0193165 | A1 | | 8/2012 | Vetesnik | |

OTHER PUBLICATIONS

DBI Sala, Full Line Catalogue 2011, Capital Safety, 78 pages.
Liftingsafety, "Manual or Powered—Rigid Arm Knock-down Counterbalance Floor Crane, Hand or Power Life & Manual Travel. Many options Inc 30 deg Rotation," 8 pages. URL: http://www.liftingsafety.co.uk/product/rigid-arm-knock-down-counterbalance-crane-3010.html#Description.
Miller by Honeywell, "Miller SkyORB Overhead Rotational Boom Anchor," Brochure, 2013, 4 pages.
Miller by Honeywell, "Miller SkyORB Overhead Rotational Boom Anchor," Installer & User Instruction Manual, Jan. 2, 2014, 80 pages.

* cited by examiner

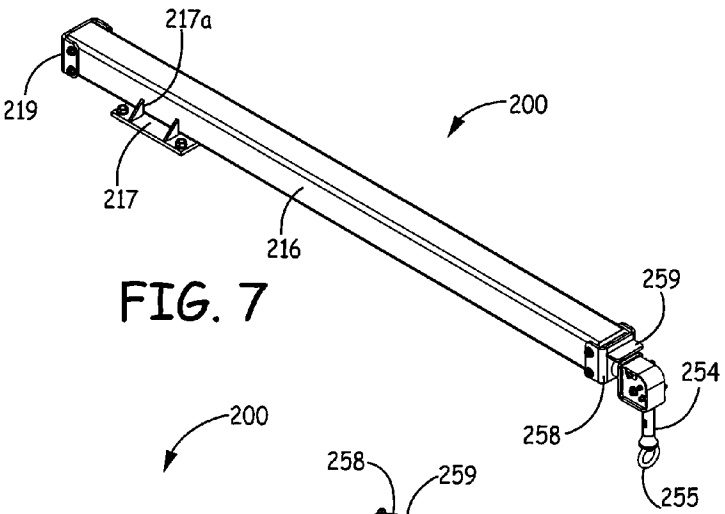
FIG. 7
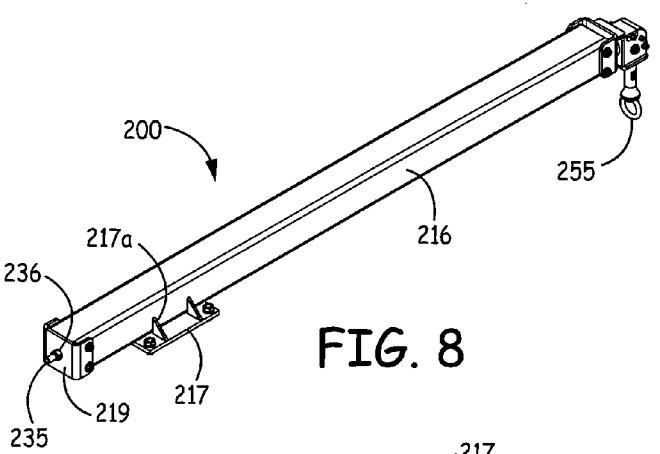
FIG. 8
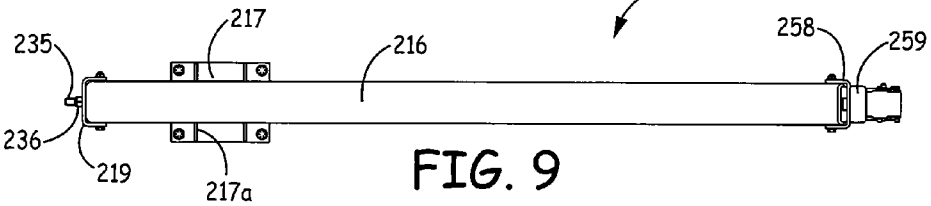
FIG. 9
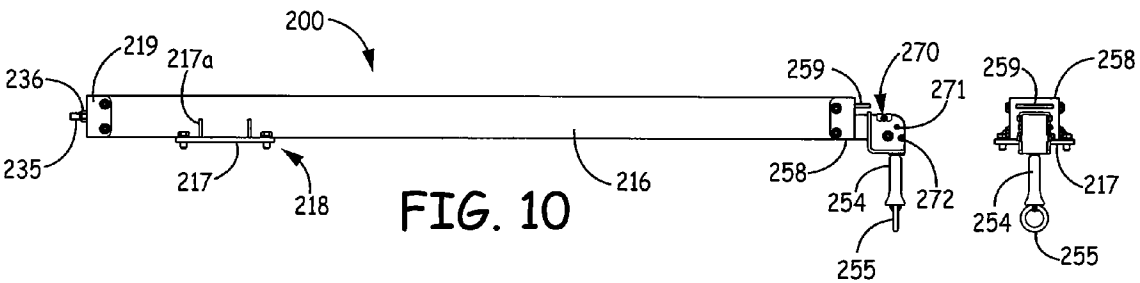
FIG. 10
FIG. 11
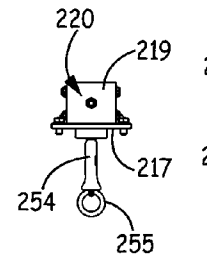
FIG. 12

SHOCK ABSORBING ANCHOR ARM ASSEMBLY

BACKGROUND OF THE INVENTION

Various occupations place people in precarious positions at relatively dangerous heights thereby creating a need for fall protection or fall-arresting safety apparatus. Among other things, such apparatus usually include a safety line interconnected between a support structure and a person working in proximity to the support structure. The safety line is typically secured to a full-body safety harness worn by the worker. A mobile or temporary support structure including an anchor arm assembly may be used, and obviously, it is important that the support structure be reliable and able to withstand the forces of a fall. It is also desirable that forces of the fall exerted upon the person be minimized.

For the reasons stated above and for other reasons stated below, which will become apparent to those skilled in the art upon reading and understanding the present specification, there is a need in the art for an improved shock absorbing anchor arm assembly.

BRIEF SUMMARY OF THE INVENTION

The above-mentioned problems associated with prior devices are addressed by embodiments of the present invention and will be understood by reading and understanding the present specification. The following summary is made by way of example and not by way of limitation. It is merely provided to aid the reader in understanding some of the aspects of the invention.

In one embodiment, a shock absorbing anchor arm assembly comprises an arm, a first connector, a second connector, an elongate member, and a shock absorber. The arm has a first arm end and a second arm end, a bore extending longitudinally through the arm, and an opening proximate the second arm end providing access to the bore. The first connector is operatively connected to the arm proximate the first arm end, and the second connector is operatively connected to the arm proximate the second arm end. The elongate member has an intermediate portion interconnecting a first connecting end and a second connecting end. The first connecting end is operatively connected to the second connector, the intermediate portion extends from the second arm end toward the first arm end and back toward the second arm end, and the second connecting end extends through the opening. The shock absorber has a first portion and a second portion. The first portion is operatively connected to the first connector, and the second portion is operatively connected to the intermediate portion of the elongate member. The shock absorber is configured and arranged to elongate thereby allowing the elongate member to be paid out from proximate the second arm end.

BRIEF DESCRIPTION OF THE DRAWINGS

The present invention can be more easily understood, and further advantages and uses thereof can be more readily apparent, when considered in view of the detailed description and the following Figures in which:

FIG. 7 is a front perspective view of another embodiment shock absorbing anchor arm assembly constructed in accordance with the principles of the present invention;

FIG. 8 is a rear perspective view of the shock absorbing anchor arm assembly shown in FIG. 7;

FIG. 9 is a top view of the shock absorbing anchor arm assembly shown in FIG. 7;

FIG. 10 is a side view of the shock absorbing anchor arm assembly shown in FIG. 7;

FIG. 11 is a front view of the shock absorbing anchor arm assembly shown in FIG. 7;

FIG. 12 is a rear view of the shock absorbing anchor arm assembly shown in FIG. 7;

In accordance with common practice, the various described features are not drawn to scale but are drawn to emphasize specific features relevant to the present invention. Reference characters denote like elements throughout the Figures and the text.

DETAILED DESCRIPTION OF THE INVENTION

Figure 1:
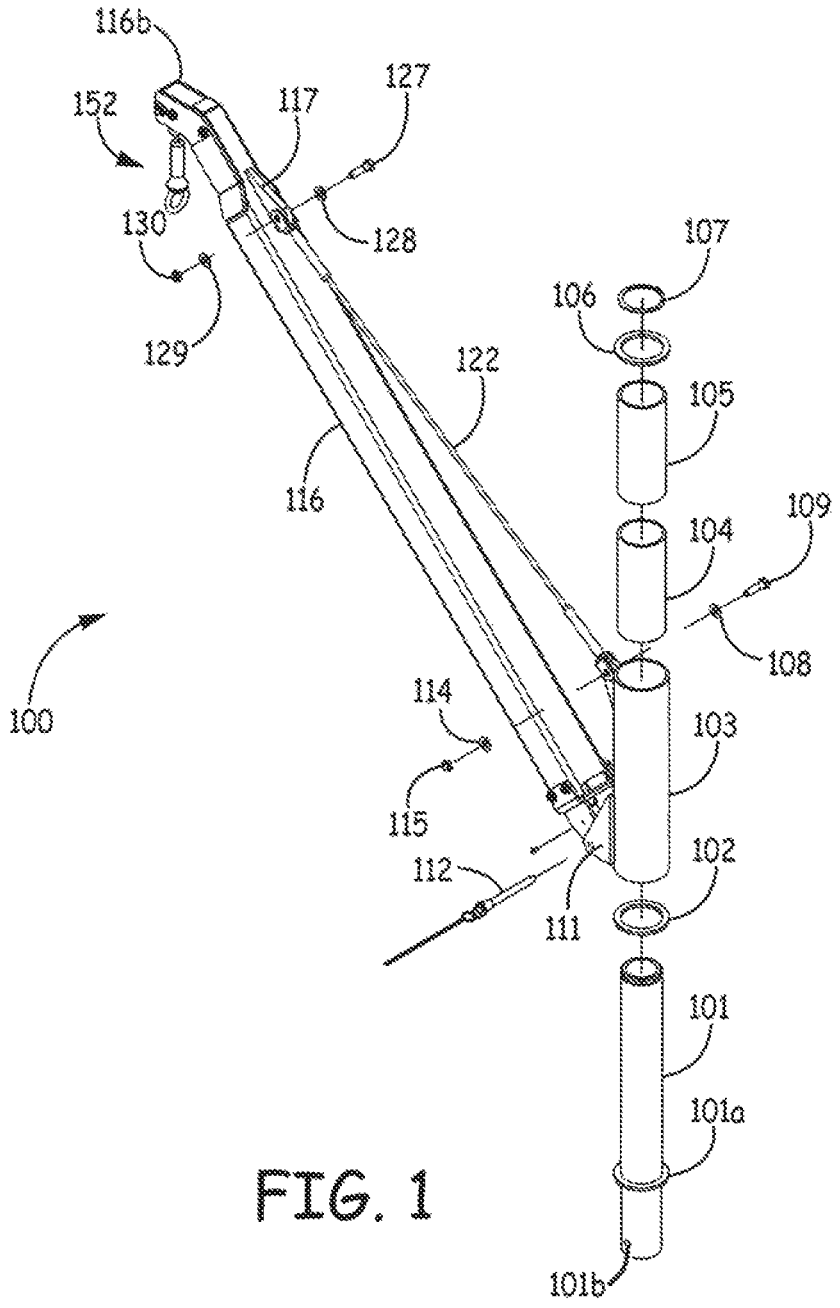
FIG. 1 is a rear partial exploded perspective view of a shock absorbing anchor arm assembly constructed in accordance with the principles of the present invention.
Figure 2:
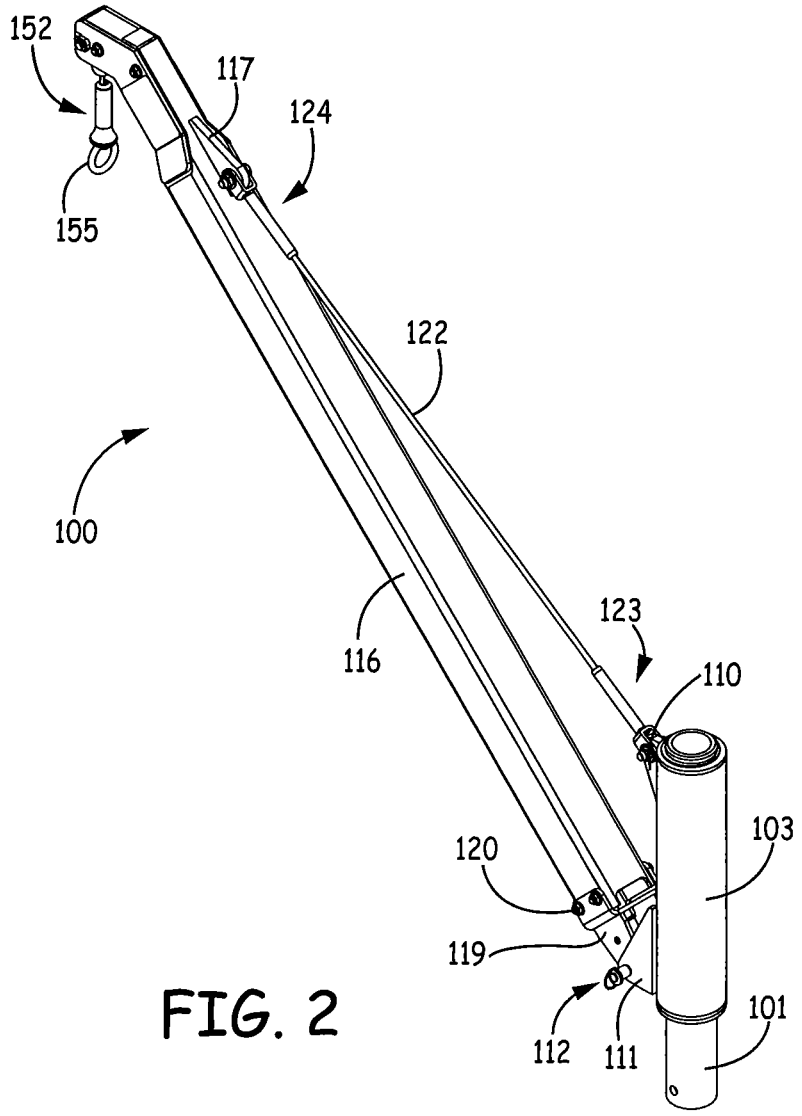
FIG. 2 is a rear perspective view of the shock absorbing anchor arm assembly shown in FIG. 1.
Figure 3:
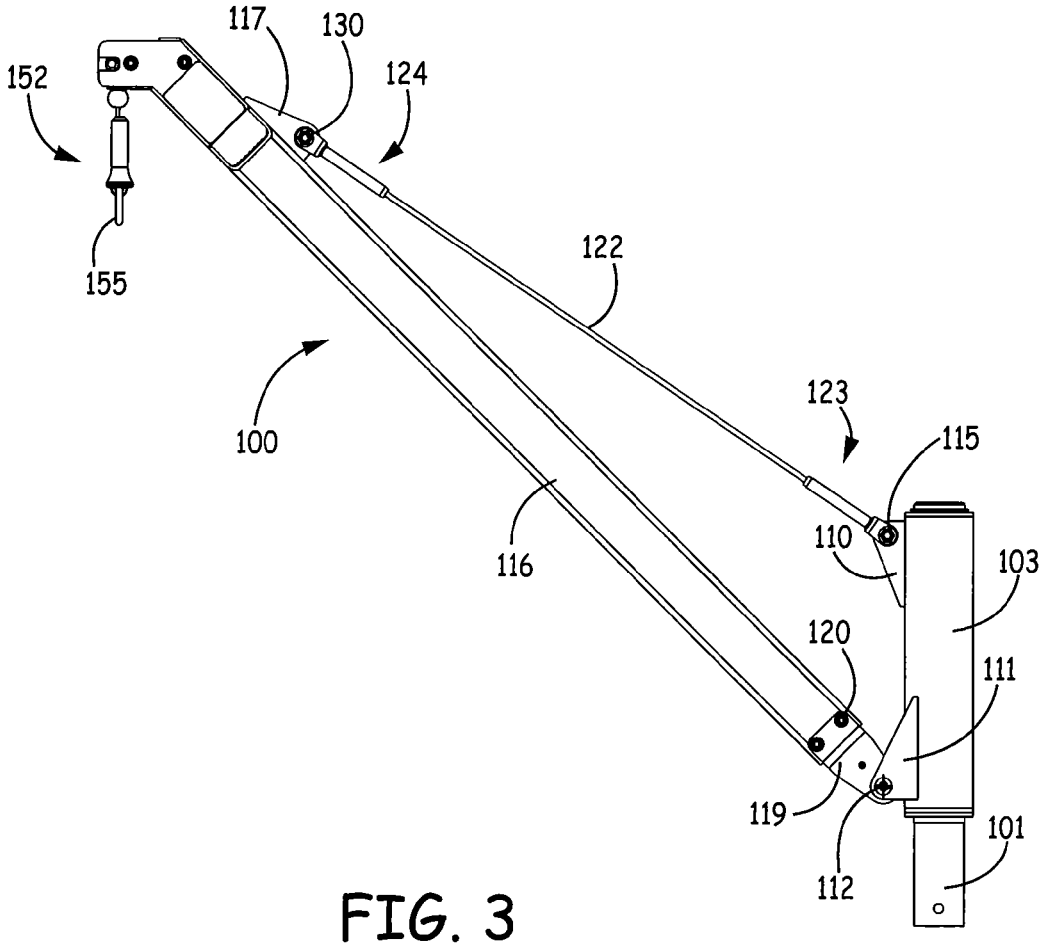
FIG. 3 is a side view of the shock absorbing anchor arm assembly shown in FIG. 1.
Figure 4:
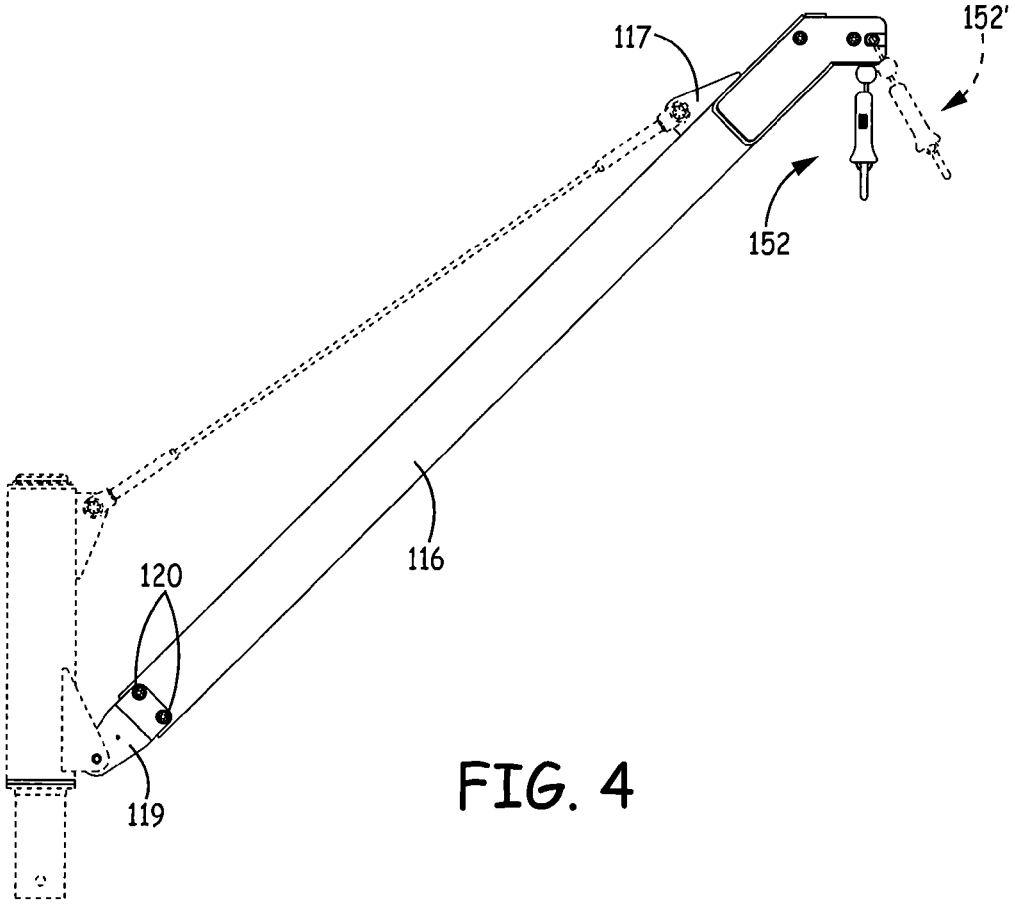
FIG. 4 is a side view of the shock absorbing anchor arm assembly shown in FIG. 1.

In the following detailed description, reference is made to the accompanying drawings, which form a part hereof, and in which is shown by way of illustration embodiments in which the inventions may be practiced. These embodiments are described in sufficient detail to enable those skilled in the art to practice the invention, and it is to be understood that other embodiments may be utilized and mechanical changes may be made without departing from the spirit and scope of the present invention. The following detailed description is, therefore, not to be taken in a limiting sense, and the scope of the present invention is defined only by the claims and equivalents thereof.

Embodiments of the present invention provide a shock absorbing anchor arm assembly that could be part of a support structure such as a light weight, mobile or temporary anchor system. The anchor system could include a counterweight assembly, which could include weights or even a vehicle acting as weights. An example of an anchor arm is a davit arm. These examples are not limiting, and it is recognized that the shock absorbing anchor arm assembly could be part of any suitable support structure.

An embodiment of the present invention provides a shock absorbing anchor arm assembly 100 including an arm 116 operatively connected to a base support 103 and a connector 101. The connector 101 could be configured and arranged to connect to any suitable base structure of the support structure, and the connector 101 and the base support 103 are only examples of types that could be used.

The connector 101 is generally cylindrical with a flange 101*a* extending outward therefrom to act as a stop for the base support 103. One end of the connector 101 includes an aperture 101*b* through which a fastener (not shown) could extend to secure the connector 101 to the suitable base structure of the support structure. A spacer 102, which is ring-like, fits over the connector 101 and is positioned proximate the flange 101*a*. The base support 103 is also generally cylindrical and fits over the connector 101, the spacer 102 separating the flange 101*a* and the base support 103. Liners 104 and 105 are configured and arranged to fit over the connector 101 and within the base support 103, and the liners 104 and 105 allow the base support 103 to pivot about the connector 101. A spacer 106 fits over the top of the connector 101 and a retaining ring 107 holds the spacer 102, the base support 103, the liners 104 and 105, and the spacer 106 together. The base support 103 includes a top bracket 110, which is a generally triangular plate member, extending outwardly proximate the top and includes a bottom bracket 111, which includes two generally triangular plate members interconnected with a connecting plate to form a U-shaped bracket, extending outwardly proximate the bottom. The connecting plate is operatively connected to the base support 103 via welding.

An arm 116 is generally tubular with a square cross-section. The arm 116 is preferably made of a light weight material, such as aluminum. The arm 116 includes a bore 116*a* extending longitudinally therethrough. A bracket 117, which is a generally triangular plate member, extends outwardly proximate one end, and the opposing end is operatively connected to a connector 119 with fasteners 120. A pin assembly 112 is configured and arranged to extend through mating apertures in the bottom bracket 111 and the connector 119 to releasably connect the arm 116 to the bottom bracket 111.

A tie-back gusset cable 122 includes a connector 123 proximate one end and a connector 124 proximate the other end. The connectors 123 and 124 include forked portions configured and arranged to connect to the brackets 110 and 117, respectively. The top bracket 110 fits between the forked portions of the connector 123, and a fastener extends through them. Washers 108 and 114 are positioned proximate the outer surfaces of the connector 123, and a bolt 109 extends through the washers 108 and 114 and the connector 123, and a nut 115 secures the bolt 109 thereto. The bracket 117 fits between the forked portions of the connector 124, and a fastener extends through them. Washers 128 and 129 are positioned proximate the outer surfaces of the connector 124, and a bolt 127 extends through the washers 128 and 129 and the connector 124, and a nut 130 secures the bolt 109 thereto.

A tension screw assembly 134 is operatively connected to the connector 119 and a portion fits within the bore 116*a* of the arm 116. The tension screw assembly 134 includes a connector 137 to which one end of a screw 135 is connected positioned within the bore 116*a*, the screw 135 extends through an aperture in the connector 119, and a nut 136 is positioned on the screw proximate the side of the connector 119 exterior to the arm 116. The connector 137 is generally U-shaped, and a round connector assembly 138 is operatively connected to the parallel sides of the connector 137.

A shock absorber 140 includes a first end 141 and a second end 142. An example of a suitable shock absorber is that used with any of the DBI SALA™ brand EZ-STOP™ Shock Absorbing Lanyards or any of the PROTECTA™ brand PRO™ Series Shock Absorbing Lanyards manufactured by D B Industries, LLC d/b/a Capital Safety USA of Red Wing, Minn. It is recognized that other suitable types of shock absorbers could be used. The first end 141 is a loop that is routed around the round connector assembly 138, and the second end 142 is a loop that is routed around a round connector assembly 145 of a connector 144. The connector 144 includes two plate members with a round connector assembly 145 proximate one end and a roller assembly 146 proximate the other end.

The arm 116 includes an extension portion 116*b*, which extends outward at an angle from the end opposite the base support 103. A bottom surface of the extension portion 116*b* includes an opening providing access to the bore 116*a*.

The arm 116 includes a connector 160 proximate a top of the end opposite the base support 103. A first end 151 of an elongate member such as a cable or webbing 150 includes a loop positioned about the connector 160, an intermediate portion of the cable or webbing 150 is routed about the roller assembly 146 of the connector 144, and a second end 152 of the cable or webbing 150 is routed between a roller assembly 161 and a bolt 162 and operatively connected to a stop 153, a bumper 154, and a connector 155. A wear pad 163 is positioned proximate an opening in the arm 116 to reduce wear on the cable or webbing 150.

Figure 5:
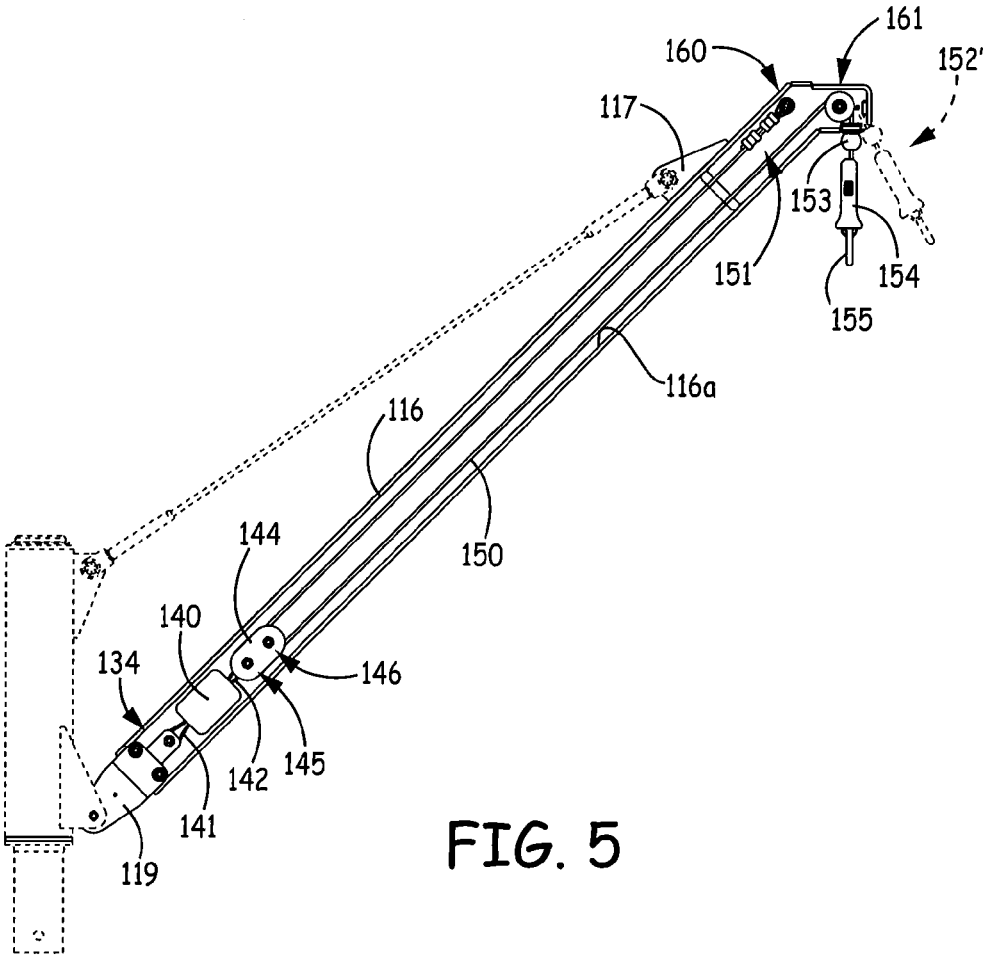
FIG. 5 is a side partial cross section view of the shock absorbing anchor arm assembly shown in FIG. 4.
Figure 6:
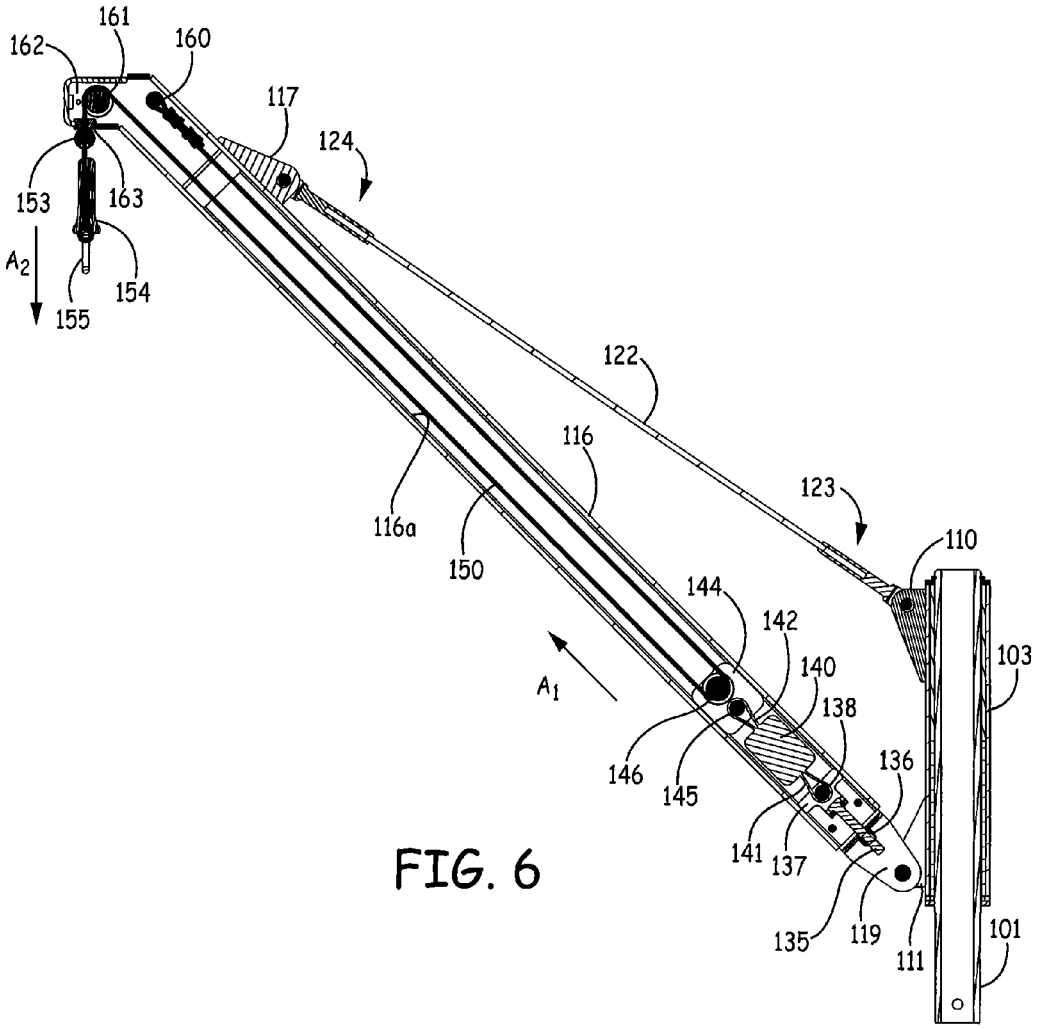
FIG. 6 is a side partial cross section view of another embodiment shock absorbing anchor arm assembly constructed in accordance with the principles of the present invention.
Figure 13:
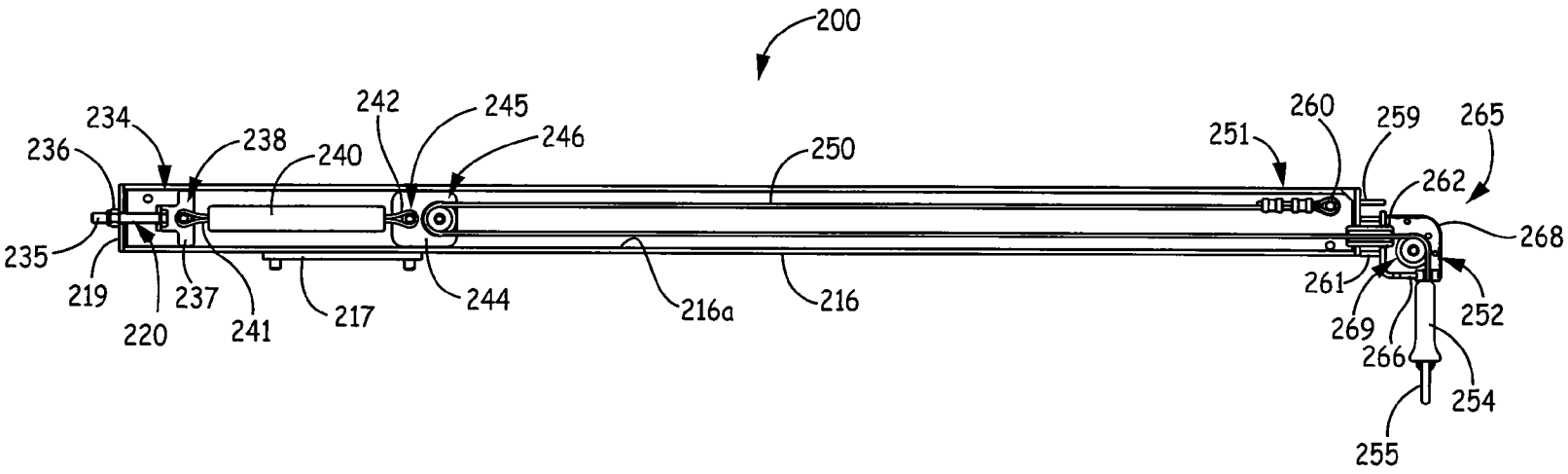
FIG. 13 is a side partial cross section view the shock absorbing anchor arm assembly shown in FIG. 7.

A suitable lifeline, such as a self-retracting lifeline, is connected to the connector 155. Should a fall occur, force exerted on the self-retracting lifeline will pull downward on the cable or webbing 150 within the bore 116*a* of the arm 116, which will cause the shock absorber 140 to elongate as it absorbs energy, thereby allowing the cable or webbing 150 to be paid out of the arm 116. As shown in at least FIGS. 5 and 6, the connector 144 will move toward the distal end of the arm 116 as the cable or webbing 150 is paid out therefrom. Arrow A1 shows the direction the connector 144 will move and arrow A2 shows the direction the connector 155 will move should a fall occur.

As the shock absorber 140 elongates, the fall distance increases, preferably 6 feet or less. The cable or webbing 150 interconnecting the shock absorber 140 and the user's lifeline (not shown) could be a color, such as red, to act as a fall indicator assisting in determining that a fall has occurred.

Another embodiment of the present invention provides a shock absorbing anchor arm assembly 200 including an arm 216 configured and arranged to be operatively connected to a support structure, and it is recognized that any suitable type of support structure could be used. The arm 216 is generally tubular with a square cross-section. The arm 216 is preferably made of a light weight material, such as aluminum. The arm 216 includes a bore 216*a* extending longitudinally therethrough. A bracket 217, which is a generally rectangular plate member, is operatively connected to a bottom of the arm 216 proximate its rear end via gussets 217*a* welded to each side, and fasteners 218 connect the bracket 217 to a suitable support structure.

A rear connector plate 219, which is generally U-shaped, covers the rear opening to the bore 216*a* and extends to portions of each side of the arm 216. Fasteners extend through aligned apertures in the tops and the bottoms of the plate 219 and the arm 216 to connect the plate 219 to the arm 216.

The tension screw assembly 234 includes a connector 237 positioned within the bore 216*a* of the arm 216, and the connector 237 includes an aperture through which the end of the screw 235 proximate its head extends. The screw 235 extends through an aperture 220 in the plate 219, and a nut 236 is positioned on the screw 235 proximate the side of the plate 219 exterior to the arm 216. The connector 237 is generally U-shaped, and a connector assembly 238 is operatively connected to the parallel sides of the connector 237.

A shock absorber 240 includes a first end 241 and a second end 242. An example of a suitable shock absorber is that used with any of the DBI SALA™ brand EZ-STOP™ Shock Absorbing Lanyards or any of the PROTECTA™ brand PRO™ Series Shock Absorbing Lanyards manufactured by D B Industries, LLC d/b/a Capital Safety USA of Red Wing, Minn. It is recognized that other suitable types of shock absorbers could be used. The first end 241 is a loop that is routed around the connector assembly 238, and the second end 242 is a loop that is routed around a connector assembly 245 of a connector 244. The connector 244 includes two generally rectangular plate members with a connector assembly 245 proximate one end and a roller assembly 246 proximate the other end.

A front connector plate 258, which like the rear connector plate 219 is generally U-shaped, covers the front opening to the bore 216*a* and extends to portions of each side of the arm 216. Fasteners extend through aligned apertures in the tops and the bottoms of the plate 258 and the arm 216 to connect the plate 258 to the arm 216. The top fastener also connects a connector 260 to the arm 216, and the bottom fastener also connects a roller 257 to the arm 216. A stop 259 extends outward proximate the top of the plate 258, and a guide member 262 extends outward proximate a bottom of the plate 258. The guide member 262 includes a bore extending longitudinally therethrough and a groove 263 extending axially about its exterior proximate its distal end.

Figures 14, 15:
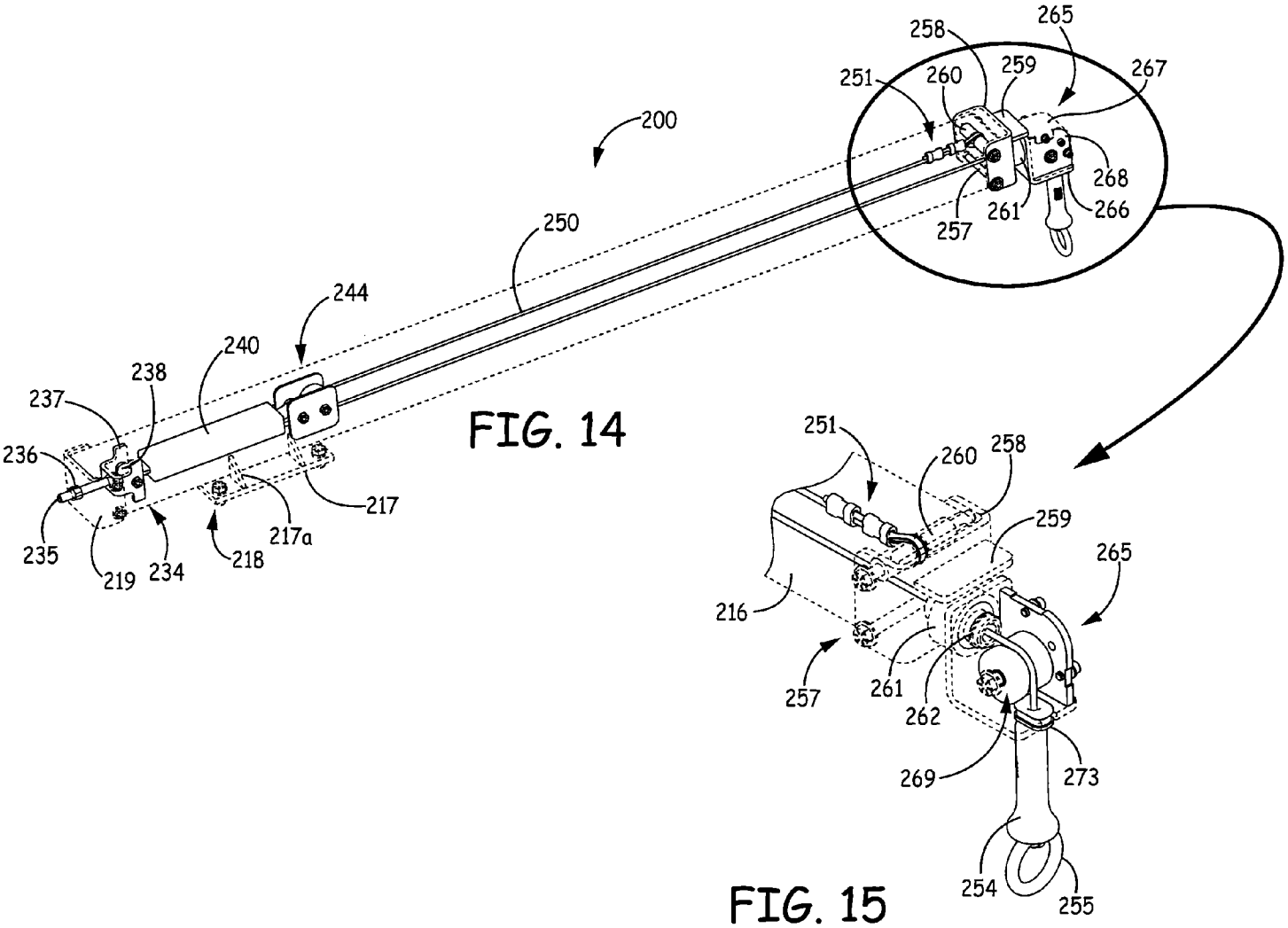
FIG. 14 is a rear perspective view of the shock absorbing anchor arm assembly shown in FIG. 7 showing the arm housing in phantom.
FIG. 15 is a front perspective view of a cable guide assembly of the shock absorbing anchor arm assembly shown in FIG. 7.
Figure 16:
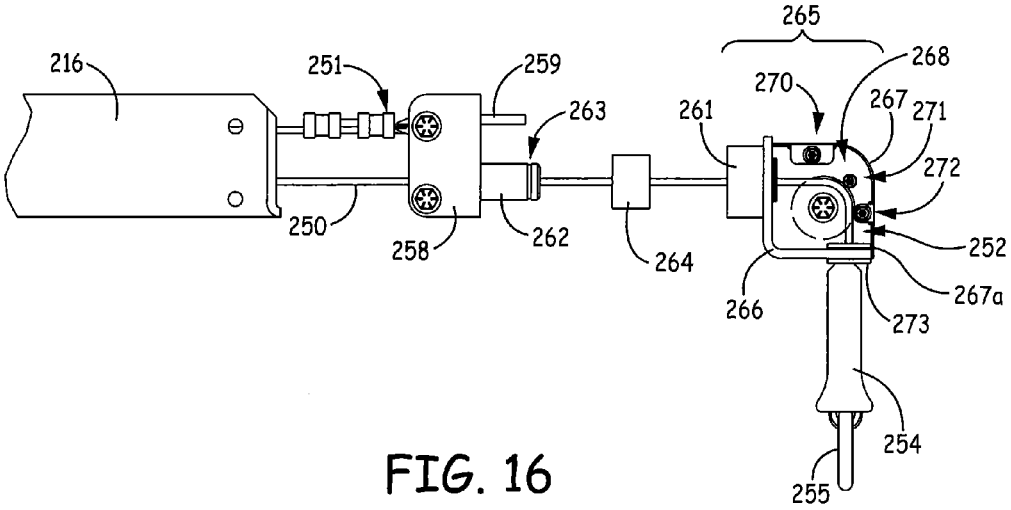
FIG. 16 is an exploded side view of the cable guide assembly shown in FIG. 15.

A pivoting cable guide assembly 265 is operatively connected to the end of the arm 216 opposite the tension screw assembly 234. The assembly 265 includes a connector plate 266, which is generally L-shaped in the view shown in FIG. 14. The connector plate 266 includes a cylindrical sleeve 261 extending outward from its rear portion. The sleeve 261 is positioned on the guide member 262 with a bushing 264 positioned between the sleeve 261 and the guide member 262. At least one snap ring (not shown), preferably two snap rings, are positioned in the groove 263 to secure the sleeve 261 and the bushing 264 on the guide member 262. Sides 268, which are generally D-shaped in the view shown in FIG. 14, are operatively connected to the connector plate 266, and a top 267 interconnects the top and the bottom of the connector plate 266 to the sides 268. The connector plate 266, the sides 268, and the top 267 form a housing. A bottom portion of the top 267 includes a cover portion 267*a*, which is configured and arranged to deform or deflect. A pulley 269 is connected to the sides 268 with a fastener extending therethrough proximate the middle of the sides, and a fastener 271 extends through the sides 268 proximate the pulley 269. The top 267 includes tabs that extend inward proximate the sides 268, and fasteners 270 and 272 interconnect the sides 268 and the tabs of the top 267. A cable guide 273 extends through the bottom distal end of the connector plate 266.

The arm 216 includes a connector 260 proximate a top of the end opposite the tension screw assembly 234. A first end 251 of an elongate member such as a cable or webbing 250 includes a loop positioned about the connector 260, an intermediate portion of the cable or webbing 250 is routed about the roller assembly 246 of the connector 244 and through a sleeve 261, and a second end 252 of the cable or webbing 250 is routed over a pulley 269 and is operatively connected to a bumper 254 and a connector 255. The fastener 271 assists in keeping the elongate member positioned about a portion of the pulley 269. A wear pad 273 is positioned proximate an opening in the arm 216 to reduce wear on the cable or webbing 250.

A suitable lifeline, such as a self-retracting lifeline, is connected to the connector 255. Should a fall occur, force exerted on the self-retracting lifeline will pull downward on the cable or webbing 250 within the bore 216*a* of the arm 216, which will cause the shock absorber 240 to elongate as it absorbs energy, thereby allowing the cable or webbing 250 to be paid out of the arm 216. The connector 244 will move in a direction toward the distal end of the arm 216 as the cable or webbing 250 is paid out therefrom. As the shock absorber 240 elongates, the fall distance increases, preferably 6 feet or less. The cable or webbing 250 interconnecting the shock absorber 240 and the user's lifeline (not shown) could be a color, such as red, to act as a fall indicator assisting in determining that a fall has occurred.

Figure 18:
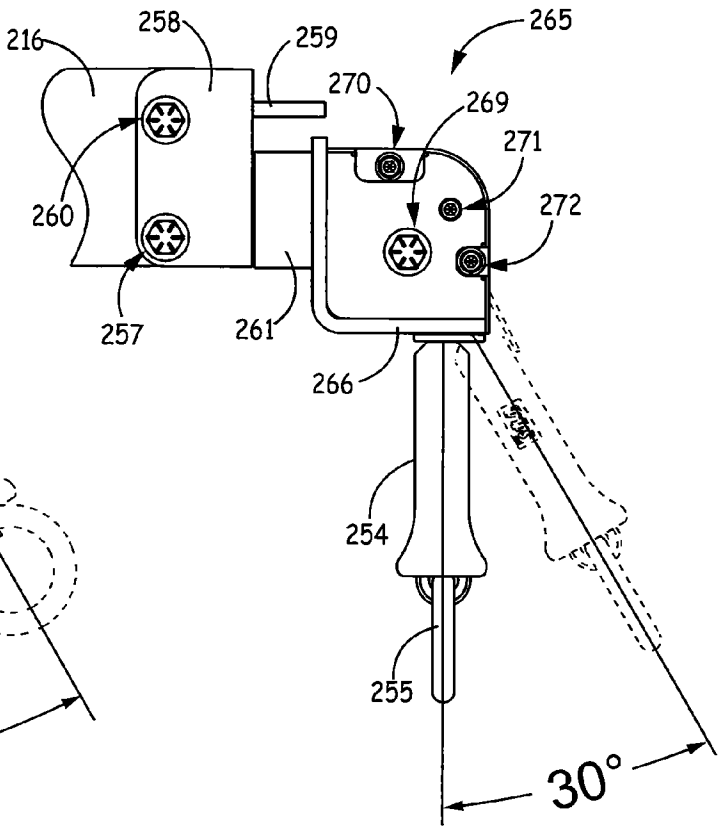
FIG. 18 is a side view of the cable guide assembly shown in FIG. 15.
Figure 17:
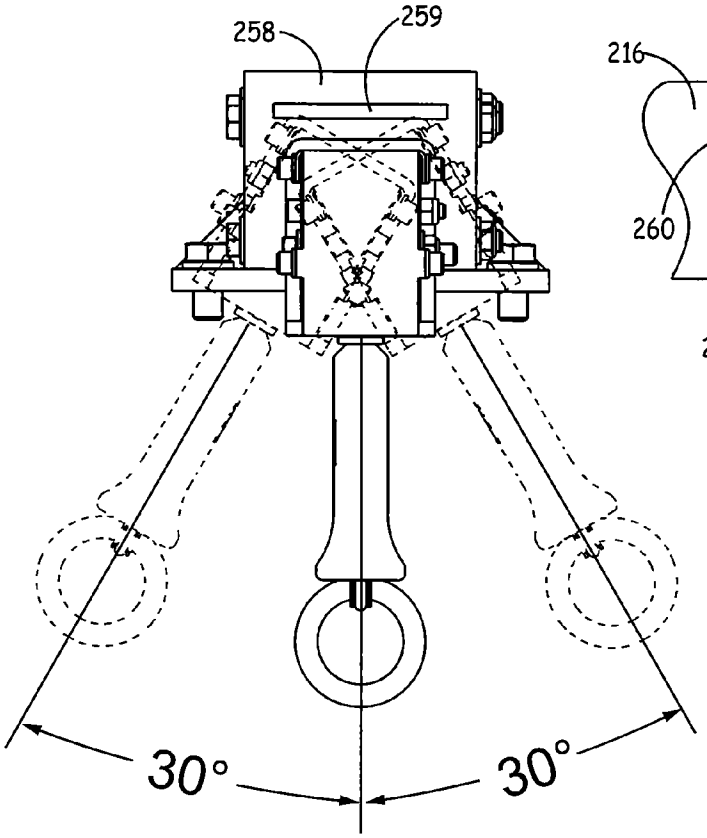
FIG. 17 is front view of the cable guide assembly shown in FIG. 15.

As shown in FIG. 17, the pivoting cable guide assembly 265 allows the cable or webbing 250 and the user's lifeline to be pulled in a direction up to 30 degrees to either side by pivoting relative to the guide member 262. The bushing 264 assists the sleeve 261 in pivoting relative to the guide member 262, and the stop 259 limits the rotation of the assembly 265 by contacting the connector plate 266. As shown in FIG. 18, the pivoting cable guide assembly 265 also allows the cable or webbing 250 and the user's lifeline to be pulled in a forward direction up to 30 degrees from vertical, and the cover portion 267*a* deforms or deflects up to 30 degrees as the cable or webbing 250 is pulled forward. Although 30 degrees is shown and described for the angles the user's lifeline could be pulled in forward and side directions, it is recognized that larger angles such as up to 90 degrees could be used. This is advantageous because, for fall events occurring at any angle up to 90 degrees away from the arm, there is no interference with the elongate member and the user's lifeline.

One advantage of the present invention is that the fall angle is not an issue because the shock absorber is contained within the arm. The load from a fall is transferred generally in-line to the shock absorber via a pulley system. Therefore, this assembly offers more flexibility for different uses. Also, there is less shock on the user's body. The energy is cut in half because if the arm were rigid and did not include such a shock absorbing mechanism, the self-retracting lifeline would limit the average arresting forces to a maximum of 900 pounds in a fall event. With such a shock absorbing mechanism, these forces are approximately cut in half thereby resulting in an average arresting force of approximately 450 pounds.

The shock absorber is connected to a 2:1 pulley reduction system compactly nested within an arm, preferably made of aluminum. This reduces the arresting force by approximately 50% and the maximum average arresting force is approximately 450 pounds. Even in non-vertical loading situations, the full arrest load is transferred directly in line with the shock absorber via the pulley system. This is different than competitors' systems in which the shock absorber is connected to the tie back gusset cable. The energy from a fall event at a 30 degree angle produces 13% less vertical load than that of a strictly vertical fall event. Therefore, competitive systems which are designed to absorb energy, based on vertical forces alone, are at a disadvantage to this system. A fall event at 30 degrees on competitive systems would yield higher arresting forces than this design.

The above specification, examples, and data provide a complete description of the manufacture and use of the composition of embodiments of the invention. Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the invention. Therefore, it is manifestly intended that this invention be limited only by the claims and the equivalents thereof.

The invention claimed is:

1. A shock absorbing anchor arm assembly, comprising:

an arm having a first arm end and a second arm end, a bore extending longitudinally through the arm, and an opening proximate the second arm end providing access to the bore;

a first connector operatively connected to the arm proximate the first arm end;

a second connector operatively connected to the arm proximate the second arm end;

an elongate member having an intermediate portion interconnecting a first connecting end and a second connecting end, the first connecting end being operatively connected to the second connector, the intermediate portion extending from the second arm end toward the first arm end and back toward the second arm end, and the second connecting end extending through the opening;

a shock absorber having a first portion and a second portion, the first portion being operatively connected to the first connector, the second portion being operatively connected to the intermediate portion of the elongate member; and wherein the shock absorber is configured and arranged to elongate thereby allowing the elongate member to be paid out from proximate the second arm end.

2. The shock absorbing anchor arm assembly of claim 1, further comprising a roller assembly operatively connected to the arm proximate the opening and the second arm end, the second connecting end extending through the opening proximate the roller assembly.

3. The shock absorbing anchor arm assembly of claim 1, wherein the first connector and the second connector are positioned within the bore of the arm.

4. The shock absorbing anchor arm assembly of claim 1, further comprising a third connector interconnecting the shock absorber and the intermediate portion of the elongate member.

5. The shock absorbing anchor arm assembly of claim 4, wherein the third connector includes a roller assembly about which the intermediate portion is routed.

6. The shock absorbing anchor arm assembly of claim 1, further comprising a lifeline connector operatively connected to the second connecting end of the elongate member, the lifeline connector being external to the arm.

7. The shock absorbing anchor arm assembly of claim 1, further comprising a connecting connector configured and arranged to connect the arm to a base support member.

8. The shock absorbing anchor arm assembly of claim 7, further comprising a tie-back gusset cable interconnecting the arm proximate the second arm end and the base support member.

9. The shock absorbing anchor arm assembly of claim 1, further comprising a bracket configured and arranged to interconnect the arm to a support structure.

10. The shock absorbing anchor arm assembly of claim 1, further comprising a connector plate operatively connected to the second arm end, the connector plate including a guide member extending outward therefrom including a bore through which the elongate member extends.

11. The shock absorbing anchor arm assembly of claim 10, further comprising a pivoting guide assembly operatively connected to the guide member, the elongate member extending through the pivoting guide assembly, and the pivoting guide assembly configured and arranged to pivot in at least one direction relative to the arm.

12. The shock absorbing anchor arm assembly of claim 11, wherein the pivoting guide assembly pivots up to 30 degrees in each direction about the guide member.

13. The shock absorbing anchor arm assembly of claim 11, further comprising a stop configured and arranged to limit movement of the pivoting guide assembly in at least one direction relative to the arm.

14. The shock absorbing anchor arm assembly of claim 1, further comprising a pivoting guide assembly operatively connected to the second arm end, the elongate member extending through the pivoting guide assembly, and the pivoting guide assembly configured and arranged to pivot in at least one direction relative to the arm.

15. The shock absorbing anchor arm assembly of claim 14, the pivoting guide assembly comprising a housing to which a pulley is operatively connected, the elongate member being routed about the pulley.

16. The shock absorbing anchor arm assembly of claim 15, wherein the housing includes a cover portion configured and arranged to deform should a force be exerted upon the elongate member in a forward direction relative to the arm.

17. The shock absorbing anchor arm assembly of claim 16, wherein the cover portion deforms to allow the elongate member to deploy up to 90 degrees from vertical.

* * * * *